US005396985A

United States Patent [19]

Seki

[11] Patent Number: 5,396,985

[45] Date of Patent: Mar. 14, 1995

[54] PACKAGE ASSEMBLY HAVING INNER POSITIONING MEANS COOPERATING WITH A WINDOW

[75] Inventor: Akihiko Seki, New York, N.Y.

[73] Assignee: Purisys Inc., New York, N.Y.

[21] Appl. No.: 136,579

[22] Filed: Oct. 13, 1993

[51] Int. Cl.[6] ..... B65D 5/50

[52] U.S. Cl. ..... 206/45.19; 206/457; 206/45.31; 206/569

[58] Field of Search ..... 206/459.5, 457, 45.31, 206/45.19, 569

[56] References Cited

U.S. PATENT DOCUMENTS

| | | | |
|---|---|---|---|
| 577,055 | 2/1897 | Mooers | 206/45.31 |
| 1,986,403 | 1/1935 | Lehmkuhl | 206/45.31 |
| 2,022,906 | 12/1935 | Weeks | 206/44 |
| 2,050,636 | 8/1936 | Taub | 224/48 |
| 2,129,701 | 10/1936 | Malocsay | 206/44 |
| 2,729,326 | 8/1951 | Stadnyk | 206/44.12 |
| 3,872,966 | 3/1975 | Gordon et al. | 206/45.31 |
| 4,131,227 | 12/1978 | Patton et al. | 229/8 |
| 4,850,488 | 7/1989 | Humbert | 206/45.31 |
| 4,911,298 | 3/1990 | Miyagawa et al. | 206/45.31 X |
| 5,207,326 | 5/1993 | Benach | 206/457 X |

FOREIGN PATENT DOCUMENTS

| | | | |
|---|---|---|---|
| 17377 | of 1929 | Australia | 206/45.31 |
| 943534 | 10/1948 | France | 206/45.31 |
| 2360280 | 3/1978 | France | 206/45.31 |
| 93153 | 11/1958 | Norway | 206/45.31 |

*Primary Examiner*—Jacob K. Ackun, Jr.
*Attorney, Agent, or Firm*—Brooks Haidt Haffner & Delahunty

[57] ABSTRACT

A package assembly has an outer container, an inner container and an inner positioning member. The inner positioning member cooperates with the outer container and the inner container to maintain the alignment of identification indicia disposed on the outer surface of the inner container so that it is visible through an aperture in the outer container.

19 Claims, 6 Drawing Sheets

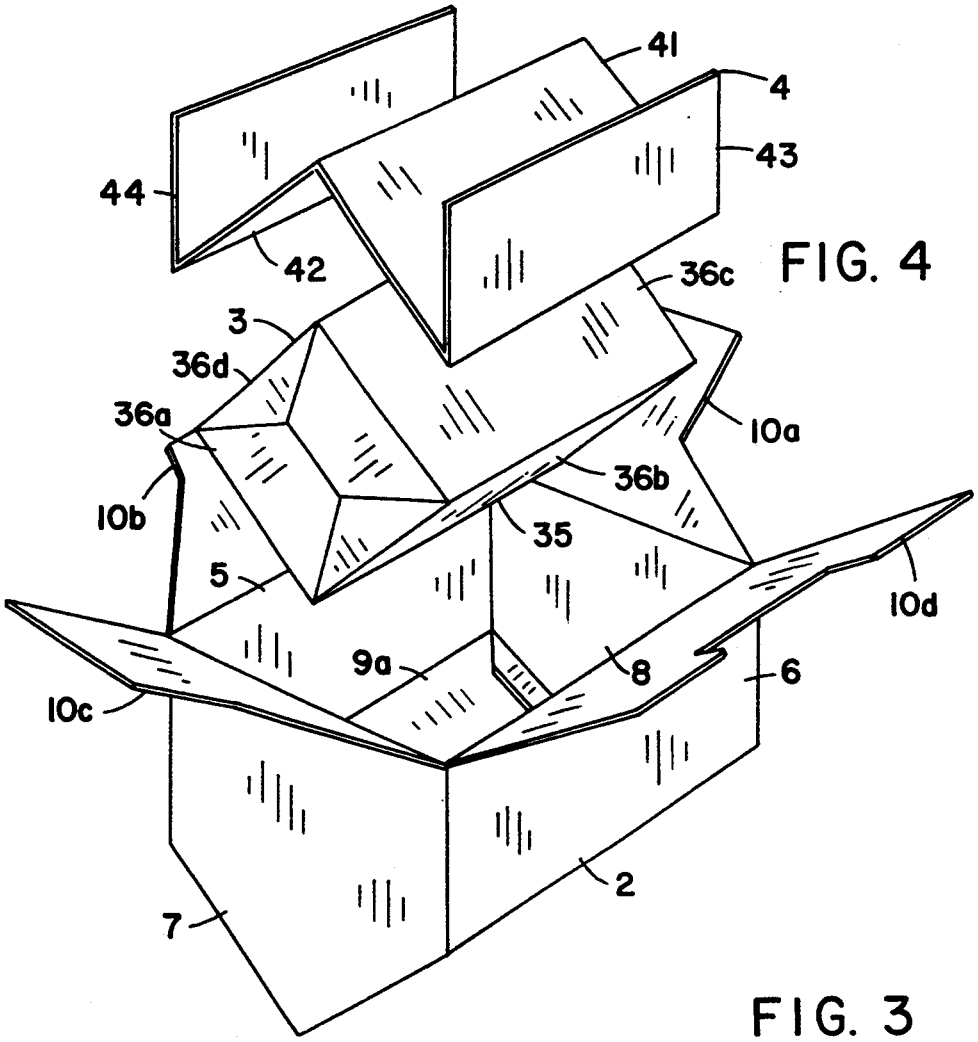
FIG. 4
FIG. 3
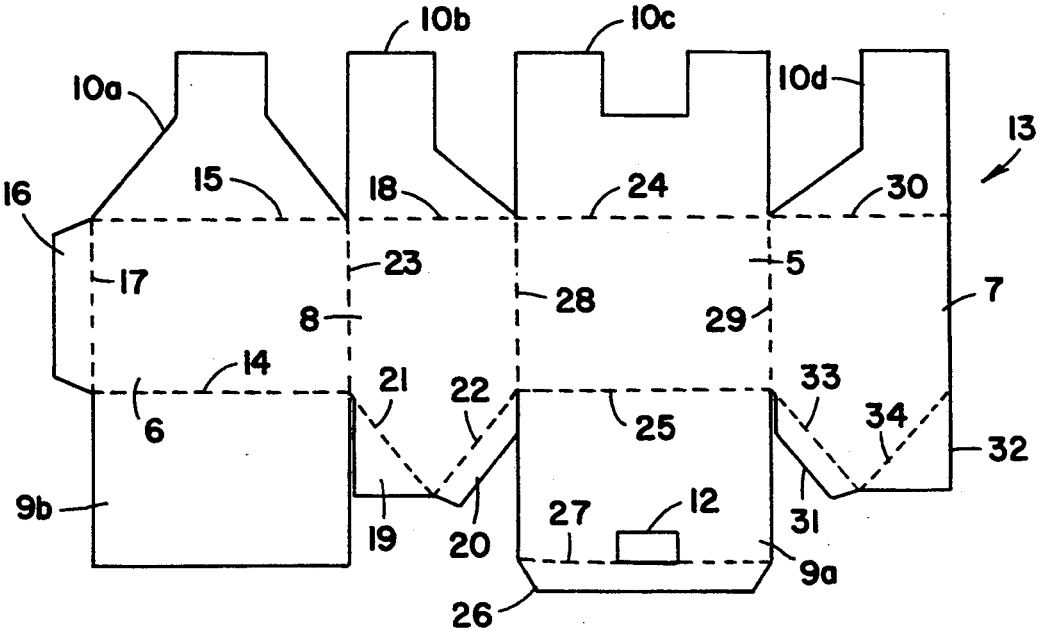

PACKAGE ASSEMBLY HAVING INNER POSITIONING MEANS COOPERATING WITH A WINDOW

BACKGROUND OF THE INVENTION

1. Field of the Invention

The present invention relates generally to containers having a window for identifying the contents therein, particularly to an outer container having an aperture for viewing an identifying indicia provided on a dissimilar inner container enclosed therein and a means for positioning the inner container within the outer container to align the indicia with the aperture.

2. Description of the Related Art

Containers having an aperture to view enclosed articles are known in the art. For example, U.S. Pat. No. 2,022,906 shows a container having a window for permitting external inspection of the mailing addresses of letters stored therein. Similarly, U.S. Pat. Nos. 2,129,701 and 2,729,326 describe cigarette containers having a series of windows for viewing tax stamps on cigarette packs placed therein. Also, U.S. Pat. No. 3,872,966 describes a shipping container having windows through which the enclosed articles are price stamped.

A visually interesting container is described in U.S. Pat. No. 4,131,227 which illustrates a storage case having the general shape of a house, i.e. having four walls, a floor and a roof. Although the decorative markings on the storage case in this reference illustrate windows, the package actually has no apertures through which to view enclosed items.

It is an object of the present invention to provide a protective and/or decorative outer container, whereby identification indicia on the surface of an enclosed inner container, having a shape dissimilar to that of the outer container, is visible through an aperture in the outer container, and whereby the orientation of the dissimilar inner container within the outer container and the orientation of the indicia to the aperture is maintained by the cooperation of a positioning member with both the inner container and the outer container.

SUMMARY OF THE INVENTION

In accordance with a preferred embodiment of the present invention, a decorative outer container has the general shape of a house and is fabricated from a single sheet of relatively rigid stock, such as corrugated cardboard or the like. The sheet is cut and folded to form the four walls, floor and peaked roof of the house-shaped container. The roof includes an aperture for viewing identification indicia which is affixed on the outer surface of an inner container having the shape of a rectangular parallelepiped. A positioning member cooperates with the outer container and the inner container so that the identification indicia is visible through the aperture.

BRIEF DESCRIPTION OF THE DRAWINGS

The invention will be better understood after reading the following detailed description of the preferred embodiments with reference to the appended drawings in which:

FIG. 3 is a plan view of an unfolded sheet of material forming the walls, roof and floor of the outer container shown in FIGS. 1 and 2;

FIG. 4 is an expanded bottom perspective view thereof showing the bottom of the house-shaped outer container in an open position and showing the configuration and orientation of the inner container and an M-shaped positioning member therein;

The same reference numbers are used throughout the drawings to designate the same or similar parts.

DETAILED DESCRIPTION OF THE INVENTION

Figure 1:
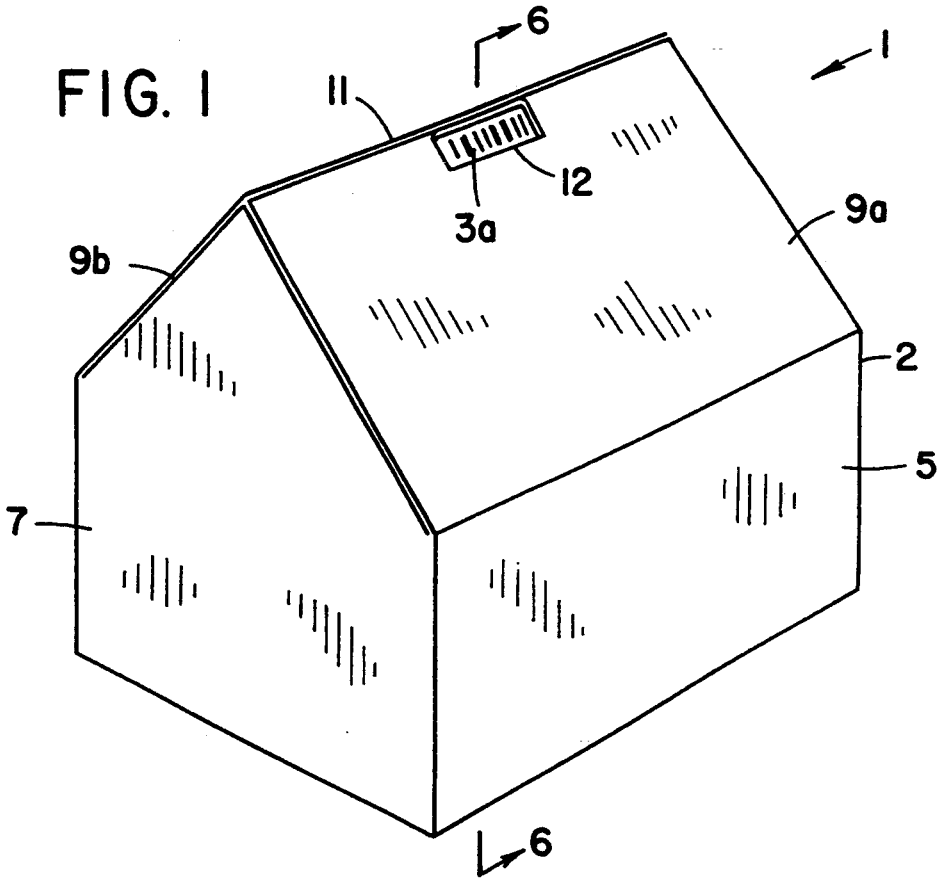
FIG. 1 is a front perspective view of the package assembly of the present invention with a house-shaped outer container fully assembled and showing an aperture in the roof through which identification indicia affixed to a portion of an inner container is viewed.
Figure 2:
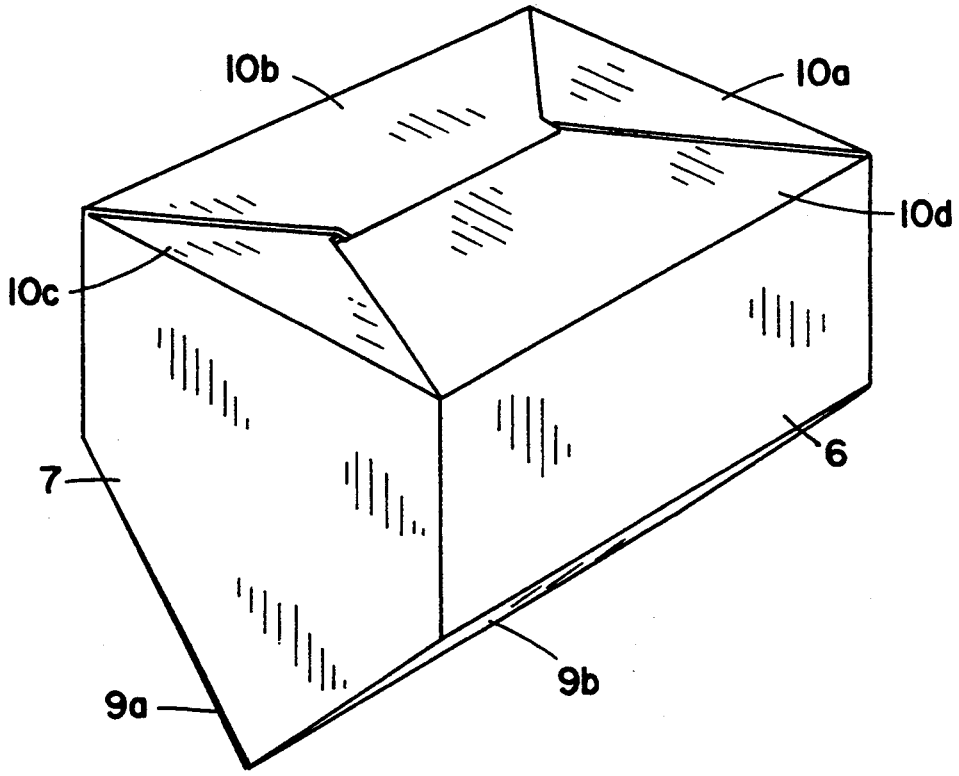
FIG. 2 is a bottom perspective view showing the bottom in its closed position.

Referring to the drawings, there is shown in FIGS. 1 and 2 a package assembly 1 of the present invention. Package assembly 1 includes an outer container 2, which has a shape generally resembling a house having four walls, a floor and a peaked roof. Package assembly 1 further includes an inner container 3 and a positioning member 4 (shown in FIGS. 4–7), which cooperating with outer container 2 supports inner container 3 within the outer container 2.

Outer container 2 has two opposed rectangular walls 5 and 6, two opposed pentagonally shaped walls 7 and 8 (shown in FIG. 3) which support inclined roof portions 9A and 9B thereon, and a floor portion 10, which is divided into four flaps 10A, 10B, 10C and 10D, which interlock together. Roof portions 9A and 9B forming the roof meet at a right angle along an apex axis 11, forming a peaked roof portion.

Also shown in FIG. 1 is an aperture 12 through roof portion 9A. Aperture or window 12 can be rectangular and has a longitudinal side substantially aligned with apex axis 11. Aperture 12 exposes an indicia **3*a* which is affixed or printed on the surface of inner container 3, which is enclosed within outer container 2. Indicia 3*a* can include any form of markings, colors and other indicia, preferably a barcode, that identifies the inner container 3. The indicia 3*a* on inner container 3 preferably has a shape and size commensurate with that of aperture 12 so that when indicia 3*a* is aligned under aperture 12 the identification markings are easily visible. It should be understood that although the aperture 12 and the indicia 3*a*** visible therethrough in the preferred embodiment are rectangular, other aperture and corresponding indicia shapes may suffice, e.g., ovals, circles, triangles, other polygons, etc.

Outer container 2 is preferably formed from a single cut sheet 13, shown in FIG. 3, which when folded and fully assembled forms the outer container 2 of FIGS. 1 and 2, which in the embodiment shown in FIG. 3 forms a house shape, but which in other embodiments may form alternate shapes. Sheet 13 is preferably made of a substantially rigid, recycled and/or recyclable material, such as corrugated cardboard, and includes a plurality of cuts, foldlines and lips, to facilitate assembly and maintain sheet 13 in the shape of that assembly.

As shown in FIG. 3, rectangular wall 6 is connected to roof portion 9B and floor portion 10A along foldlines 14 and 15, respectively. A lip 16 is connected to wall 6 along foldline 17. Wall 8 is connected to floor portion 10B along foldline 18, and has two lips, 19 and 20, extending from the peaked portion of wall 8 along foldlines 21 and 22, respectively. Wall 8 is also connected to wall 6 along foldline 23.

Wall 5 is connected to floor portion 10C along foldline 24 and to roof portion 9A along foldline 25. A lip 26 is connected to roof portion 9A along foldline 27. Wall 5 is further connected to wall 8 along foldline 28 and wall 7 along foldline 29. Wall 7 is connected to floor portion 10D along foldline 30, and has two lips 31 and 32, extending from the peaked portion of wall 7 along foldlines 33 and 34, respectively.

All of the above foldlines are formed on sheet 13 and all preferably fold in the same direction, e.g. upwards from the planar surface shown in FIG. 3. The one-sheet foldable construction of outer container 2 simplifies the manufacturing process and reduces the assembly costs.

Outer container 2 in this embodiment is folded into a house shape by first folding sheet 13 along foldlines 23, 28 and 29, forming the side walls 5–8 of the house, and interlocking the four floor portions 10A–10D to form the floor 10. Lip 16 attached to wall 6 along foldline 17 is attached, preferably glued, to the inner surface of wall 7, i.e. the interior of the house, to hold the walls 5–8 in place. Lips 19 and 32 connected to the peaked portions of walls 8 and 7 along foldlines 21 and 34, respectively, are attached, preferably glued, to the inner surface of roof portion 9B. Similarly, lips 20 and 31 connected to the peaked portions of walls 8 and 7 along foldlines 22 and 33, respectively, are attached, preferably glued, to the inner surface of roof portion 9A. Also, lip 26 connected to roof portion 9A along foldline 27 is attached, preferably glued, to the inner surface of roof portion 9B, thereby creating apex axis 11 and completing the assembly of the outer container 2. Inner container 3 and positioning member 4 are placed within the outer container 2 prior to completing assembly.

Figure 5:
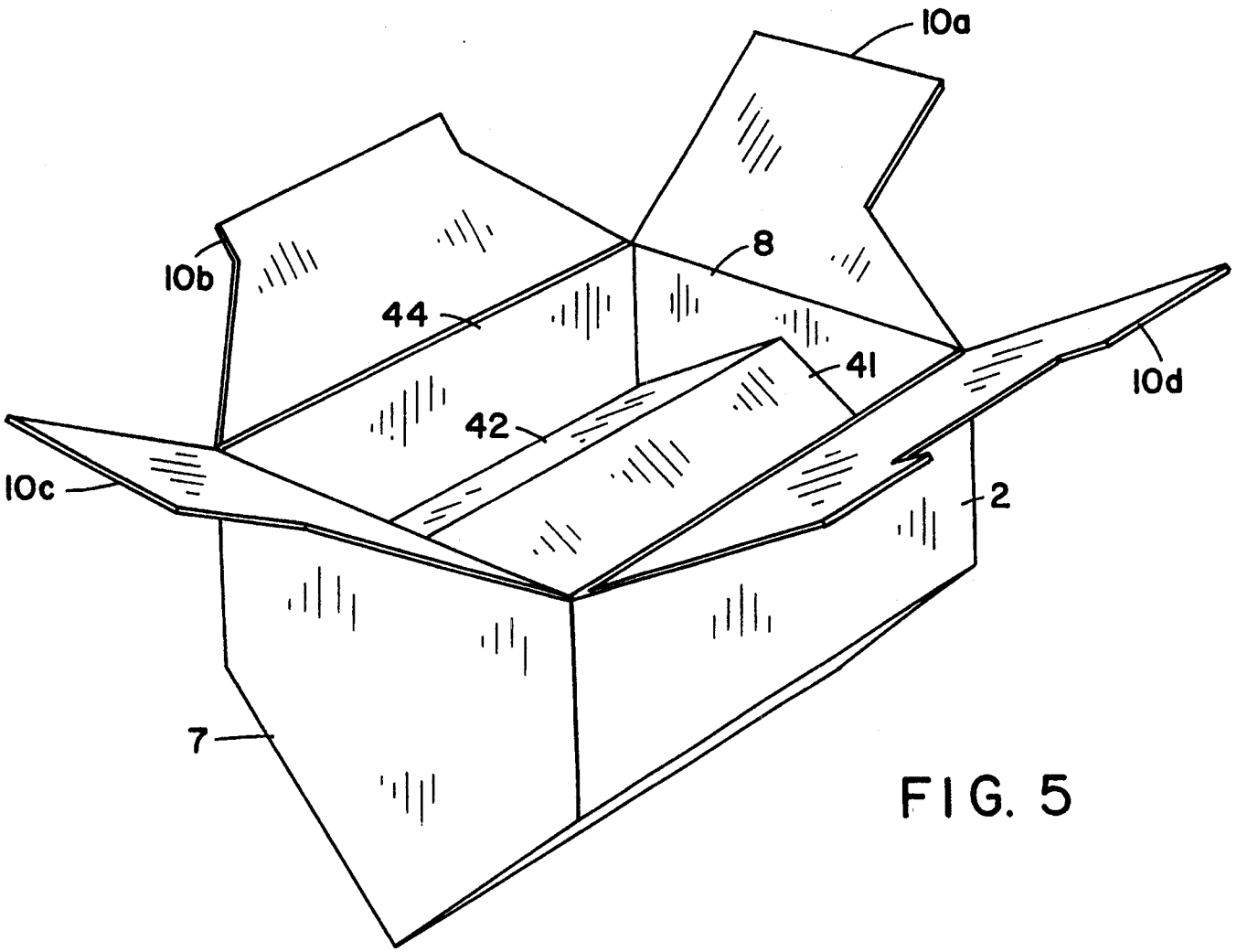
FIG. 5 is a bottom perspective view as in FIG. 4 showing the final position of the enclosed items.
Figure 6:
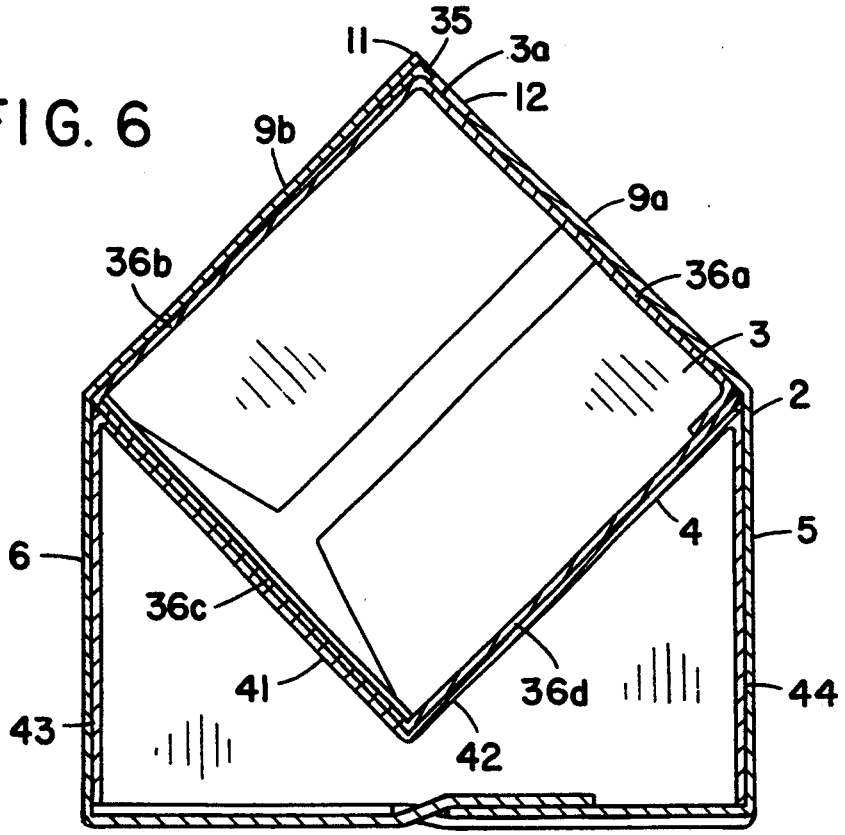
FIG. 6 is a cross-sectional view taken along the midline 6—6 of FIG. 1.
Figure 7:
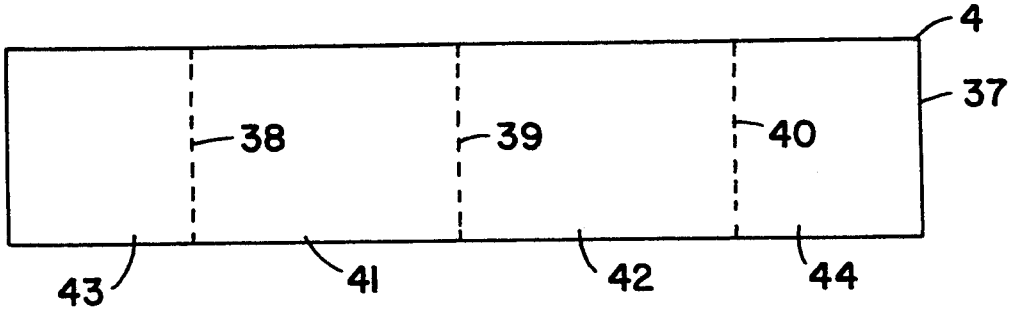
FIG. 7 is a plan view of an unfolded sheet of material forming the M-shaped member shown in FIGS. 4–6.

Shown in FIGS. 4 and 5 are perspective views of package assembly 1 partially disassembled to illustrate the preferred placement and orientation of the inner container 3 and positioning member 4 within outer container 2, which is shown inverted with the floor flaps 10A–10D folded back. Inner container 3, shown in FIG. 4, is preferably in the shape of a rectangular parallelepiped, a shape dissimilar to that of the house-shaped outer container 2. Inner container 3 is oriented diagonally with a downward edge 35, facing the interior of the peaked roof portion, and sides 36A–D. When package assembly 1 is fully assembled and inverted, as shown in cross-section in FIG. 6, a cross-sectional view taken along line 6—6 in FIG. 1, edge 35 of inner container 3 is closely adjacent to and substantially aligned along apex axis 11. As also shown in FIG. 6, sides 36A and 36B of inner container 3 along either side of edge 35 are in close contact with the interior of roof portions 9A and 9B, respectively. Preferably, the lengths and widths of sides 36A and 36B are commensurate with that of the interior dimensions of roof portions 9A and 9B, thereby forming a close fit between the part of inner container 3 within the interior of the peaked roof portion of outer container 2.

As shown in FIG. 6, the widths of sides 36A–D of inner container 3 are preferably equal, thereby forming a square in cross-section, and inner container 3 preferably fills the entire internal peaked roof portion of outer container 2. It should be understood, however, that the cross-section of inner container 3 need not be square and the internal peaked roof portion of outer container 2 need not be entirely filled.

Also shown in FIGS. 4–6 is positioning member 4, which positions inner container 3 within outer container 2 and aligns the indicia 3*a* on inner container 3 with the aperture 12, and which is preferably M-shaped (as seen in FIG. 6 and inverted in FIGS. 4 and 5). Positioning member 4 is also preferably formed from a single sheet 37, shown in FIG. 7, made of a substantially rigid, recycled and/or recyclable material, such as corrugated cardboard, and includes foldlines 38, 39 and 40, which when folded forms the sheet 37 into the M-shape. Foldlines 38–40, unlike the foldlines in sheet 13, fold in alternating directions in relation to the plane of the sheet 37 in order to form the M-shape. When positioned within outer container 2, as shown in FIG. 6, a pair of inner legs 41 and 42 of positioning member 4 meet substantially perpendicularly along foldline 39 to receive and support the other two sides, 36C and 36D, respectively, of inner container 3, which also meet at right angles. A pair of outer legs 43 and 44, connected to inner legs 41 and 42 along foldlines 38 and 40, respectively, provide support for the inner container 3 resting on inner legs 41 and 42. Legs 41–44 are proportioned so that when positioned within outer container 2, outer legs 43 and 44 are vertical and contact sides 6 and 5, respectively, and inner legs 41 and 42 form a substantially right angle to receive and support inner container 3.

Preferably, the length of outer legs 43 and 44 substantially equals the height of the rectangular walls 5 and 6 and the length of inner legs 41 and 42 substantially equals the side lengths (36C, 36D) of the enclosed inner container 3. It should be understood, however, that outer support legs 43 and 44 need not be equal to the height of walls 5 and 6, and may be shorter. Similarly, if alternate shapes or non-right angled configurations of inner container 3 are employed, the number, configuration and lengths of inner legs 41 and 42 may vary.

Although inner container 3 preferably has the configuration of a conventional box, i.e. a rectangular parallelepiped or a cube, other configurations are within the scope of the present invention, so long as the shape or configuration of inner container 3 is dissimilar to that of outer container 2. For example, inner container 3 may have a rectangular or general prism shape having two sides, corresponding to sides 36A and 36B, meeting at a non-right angle which is commensurate with the angle formed by roof portions 9A and 9B of outer container 2. Inner legs 41 and 42 of positioning member 4 could meet at the same or a different angle to receive and support the remaining sides. It should be understood that positioning member 4 may have an alternative shape to receive the remaining sides. For instance, where inner container 3 has the shape of a triangular prism or wedge, a single flat base surface remaining will require support within outer container 2 by an alternative positioning member 4 having a flat receiving surface and a centered support leg. Where inner container 3 is a general prism or other polyhedron, positioning member 4 preferably offers a commensurate number of support surfaces. Further, although regular polyhedral shapes for inner container 3 are preferred, irregular polyhedral or non-polyhedral shapes, e.g. arcs and curves, may be employed. Consequently, roof portions 9A and 9B may each include multiple surfaces and/or curved surfaces that correspond to the shape of the underlying inner container 3. Aperture 12 may be placed along any one of the flat or curved surfaces of roof portions 9A and 9B.

Figure 8:
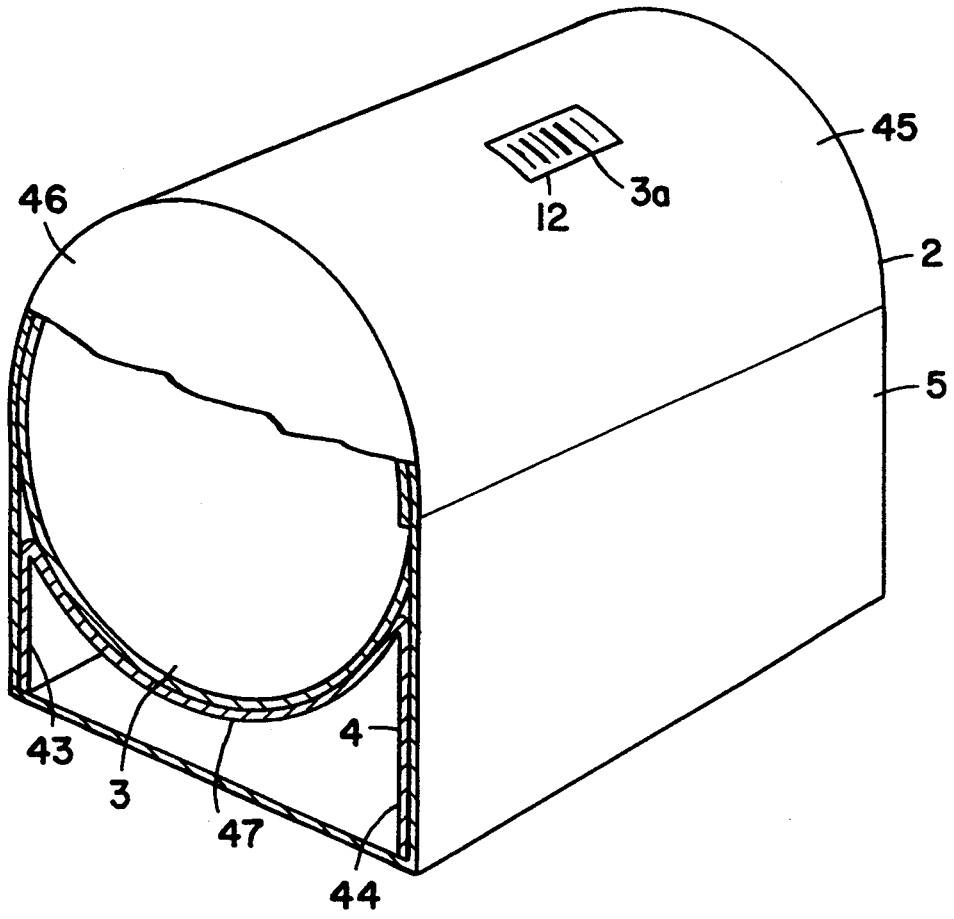
FIG. 8 is a front perspective view, partially in cross-section, of an alternate embodiment of the package assembly of the present invention with the outer container having a curved roof with an aperture through which identification indicia affixed to a portion of a cylindrically-shaped inner container is viewed.

Shown in FIG. 8 is an alternate embodiment of the package assembly 1 of the present invention showing outer container 2 with a hemicylindrical curved roof 45. Wall 46 (shown partially removed) in this embodiment, corresponding to wall 7 of the previous embodiment, instead of being pentagonal has a hemicircular top portion. Inner container 3 within outer container 2 preferably has a cylindrical configuration and has a length and diameter commensurate with that of the hemicylindrical roof 45 so as to fit closely within the roof portion as in the previous embodiment. The position of inner container 3 within outer container 2 is supported and maintained by an alternative positioning member 4 which also aligns the window or aperture 12 with the affixed indicia 3*a*. Positioning member 4 in this embodiment is a one-piece curved inner leg 47, which corresponds to both of inner legs 41 and 42 of the previous embodiment, and which is attached to outer legs 43 and 44.

Figure 9:
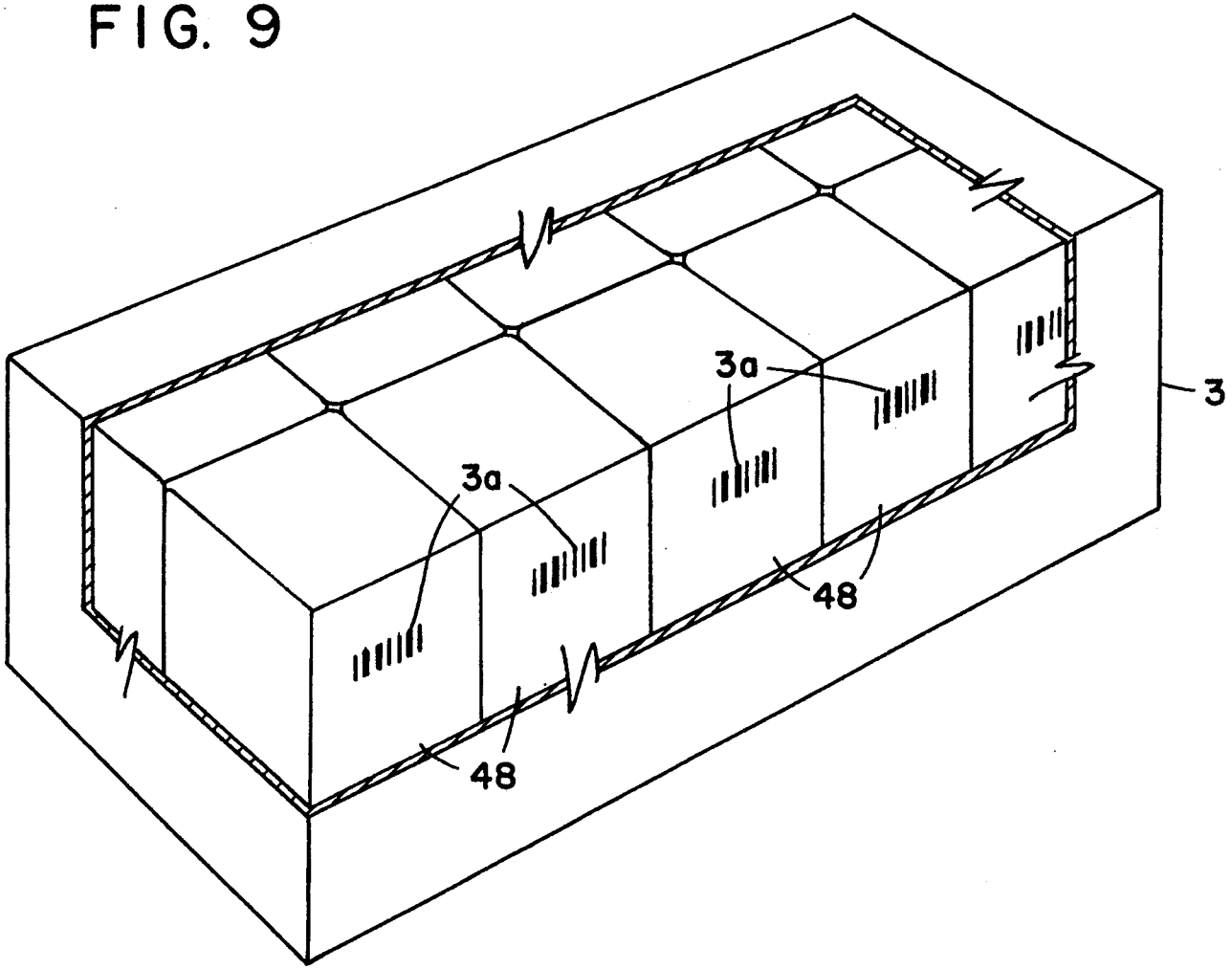
FIG. 9 is a perspective cutaway view illustrating a plurality of articles within the inner container, each of the plurality of articles having the same identification indicia affixed thereto.

The contents of inner container 3 may include a biological or chemical test kit (not shown) having a plurality of test vials, reagants, labels and forms all bearing the same identification indicia as that on the outside surface of inner container 3 which is visible through aperture 12 of package assembly 1. Thus, the inner container 3 containing the test kit as well as each component within the kit can be monitored separately and the custody controlled by means of the identification indicia thereon. For example, referring to FIG. 9, a test kit comprised of a plurality of articles 48 within inner container 3 for testing pesticides in drinking water can have several test vials therein, each vial bearing the same or similar indicia 3*a*, e.g. a barcode, as that on the outer surface of inner container 3. Thus, when the water samples are mailed to a testing laboratory in the package assembly 1 of the present invention, each sample can be tested separately, sometimes in different buildings, cities, states or even countries. The common identification indicia among the diverse samples, however, allows ready identification of a particular sample's source and allows simple custody checks.

One production advantage of the present invention is that the components of package assembly 1 may be assembled separately. For example, properly affixing or printing the identification indicia on the inner container 3 and its contents, e.g. test kit vials, may be done by a first group of employees charged with cataloging and monitoring such kits. The assembled inner container 3 is then passed to a less skilled second group of employees charged with packing inner container 3 within outer container 2 using the positioning member 4 so that the indicia 3*a* on inner container 3 shows through the aperture 12. The division of labor thus increases productivity and efficiency and facilitates quality control.

Although the outer container 2 is preferably of a one-piece construction, it should be understood that the container can be made of several discrete pieces attached, e.g. glued, to each other.

It should be understood that a plurality of positioning members 4 could be employed within outer container 2 to position inner container 3 therein so that the indicia 3*a* thereon is exposed through aperture 12.

It should also be understood that inner container 3 may include a plurality of indicia visible through a single aperture 12 or outer container 2 may include a plurality of apertures 12 to view a plurality of indicia 3*a*.

It should further be understood that although the preferred placement of aperture 12 is along apex axis 11 of the roof portion 9A (or 9B), aperture 12 may be placed along any portion of the roof or any portion of the rest of container 2 so long as indicia 3*a* are aligned with aperture 12 so that the indicia 3*a* are externally visible through outer container 2.

Although preferred embodiments of the present invention have been described and illustrated, it will be apparent to those skilled in the art that various modifications may be made without departing from the principles of the invention.

What is claimed is:

1. A package assembly, comprising:

an outer container having an aperture therethrough;

an inner container disposed within the outer container, said inner container having a configuration different from the outer container;

a plurality of articles disposed within the inner container;

an indicia disposed on an outer surface of the inner container and said indicia being disposed on each of said articles; and a positioning means cooperating with the outer container and the inner container so that the indicia disposed on an outer surface of the inner container is visible through the aperture.

2. The assembly of claim 1, wherein the outer container is shaped to resemble a house having four walls, a peaked roof and a floor.

3. The assembly of claim 2, wherein the house-shaped container is formed from a single sheet of rigid stock shaped and folded to form the four walls, roof and floor.

4. The assembly of claim 2, wherein the aperture is through the roof.

5. The assembly of claim 4, wherein the peaked roof has an apex axis and the aperture is substantially aligned along the apex axis.

6. The assembly of claim 1, wherein the outer container is made of corrugated cardboard.

7. The assembly of claim 1, wherein the aperture through the outer container has a shape selected from the group consisting of rectangles, triangles, circles and ovals.

8. The assembly of claim 1, wherein the inner container has the shape selected from the group consisting of rectangular parallelepipeds, cubes and cylinders.

9. The assembly of claim 1, wherein the outer container has a plurality of apertures.

10. The assembly of claim 1, wherein the inner container has a plurality of indicia.

11. The assembly of claim 1, wherein the indicia includes a barcode.

12. The assembly of claim 1, wherein the positioning means is an M-shaped member.

13. The assembly of claim 12, wherein the M-shaped member comprises a pair of inner and a pair of outer legs, wherein when the M-shaped member is positioned within the outer container, the outer legs are in contact with the sides of the outer container and are substantially vertical, and the inner legs meet at a substantially right angle.

14. The assembly of claim 1, wherein said positioning means is made of corrugated cardboard.

15. A package assembly comprising:

an outer container shaped to resemble a house having four walls, a peaked roof and a floor, said outer container having an aperture through the roof;

an inner container disposed within the outer container, said inner container having the shape of a rectangular parallelepiped and having an indicia disposed on an outer surface thereof; and an M-shaped positioning member cooperating with the outer container and the inner container so that the indicia is visible through the aperture.

16. The assembly of claim 15, wherein said inner container includes a test kit containing a plurality of articles, each article having the same indicia as that disposed on the outer surface of the inner container.

17. A custody control system comprising:

an outer container having an aperture therethrough;

an inner container disposed within the outer container;

a custody control indicia disposed on an outer surface of the inner container, said custody control indicia also being disposed on a plurality of articles within the inner container; and a positioning means cooperating with the outer container and the inner container so that the custody control indicia on said outer surface of the inner container is visible through the aperture.

18. The system of claim 17, wherein the outer container is shaped to resemble a house having four walls, a roof and a floor, and wherein said aperture is through the roof.

19. The system of claim 17, wherein said inner container comprises a test kit containing a plurality of test vials, each of the test vials having the same custody control indicia as that on the inner container.

* * * * *